US005479910A

United States Patent [19]

Bauer et al.

[11] Patent Number: 5,479,910

[45] Date of Patent: Jan. 2, 1996

[54] METHOD AND DEVICE FOR CONTROLLING AN INTERNAL COMBUSTION ENGINE

[75] Inventors: Hans-Peter Bauer, Ditzingen; Herbert Schneider; Thomas Kuettner, both of Stuttgart, all of Germany

[73] Assignee: Robert Bosch GmbH, Stuttgart, Germany

[21] Appl. No.: 410,628

[22] Filed: Mar. 24, 1995

[30] Foreign Application Priority Data

May 4, 1994 [DE] Germany ..... 44 15 640.5

[51] Int. Cl.[6] ..... F02M 17/00; F02M 37/04

[52] U.S. Cl. ..... 123/179.17; 123/501

[58] Field of Search ..... 123/179.17, 500, 123/501, 502

[56] References Cited

U.S. PATENT DOCUMENTS

| | | | |
|---|---|---|---|
| 4,426,981 | 1/1984 | Greiner et al. . | |
| 4,503,830 | 3/1985 | Nakamura | 123/501 |
| 4,669,429 | 6/1987 | Nishida | 123/179.17 |
| 4,736,726 | 4/1988 | Matsuno | 123/501 |
| 4,757,795 | 7/1988 | Kelly | 123/501 |
| 4,763,630 | 8/1988 | Nagase | 123/501 |
| 4,785,771 | 11/1988 | Ibuki | 123/179.17 |
| 4,790,135 | 12/1988 | Jautelat | 123/179.17 |
| 4,867,115 | 9/1989 | Henein | 123/179.17 |
| 5,107,700 | 4/1992 | Küttner et al. . | |
| 5,315,976 | 5/1994 | Birk | 123/501 |
| 5,394,844 | 3/1995 | Akimoto | 123/179.17 |

FOREIGN PATENT DOCUMENTS

| | | | |
|---|---|---|---|
| 3118425 | 12/1982 | Germany . | |
| 3612808 | 10/1987 | Germany . | |
| 0027064 | 3/1981 | Japan | 123/179.17 |
| 0203826 | 12/1982 | Japan | 123/179.17 |
| 0047130 | 3/1983 | Japan | 123/501 |
| 0119063 | 7/1984 | Japan | 123/501 |

*Primary Examiner*—Carl S. Miller
*Attorney, Agent, or Firm*—Kenyon & Kenyon

[57] ABSTRACT

In a method and device for controlling an internal combustion engine, the fuel quantity injected into the combustion chambers of the internal combustion engine and/or the start of pump delivery are determined by means of a pressure sensor. In so doing, a duration-of-pump-delivery signal, which represents a measure for the injected fuel quantity, is predefined on the basis of a start-of-pump-delivery signal and an end-of-pump-delivery signal. The start-of-pump-delivery signal and/or the end-of-pump-delivery signal are recognized as being plausible when the duration-of-pump-delivery signal is greater than a first threshold value.

14 Claims, 5 Drawing Sheets t
T1
T2
T4
T5
T6
T7
SP1
SP2 t
T1
T2
T3
T4
T5
T6
T7
T8
T9
T10
SP1
SP2

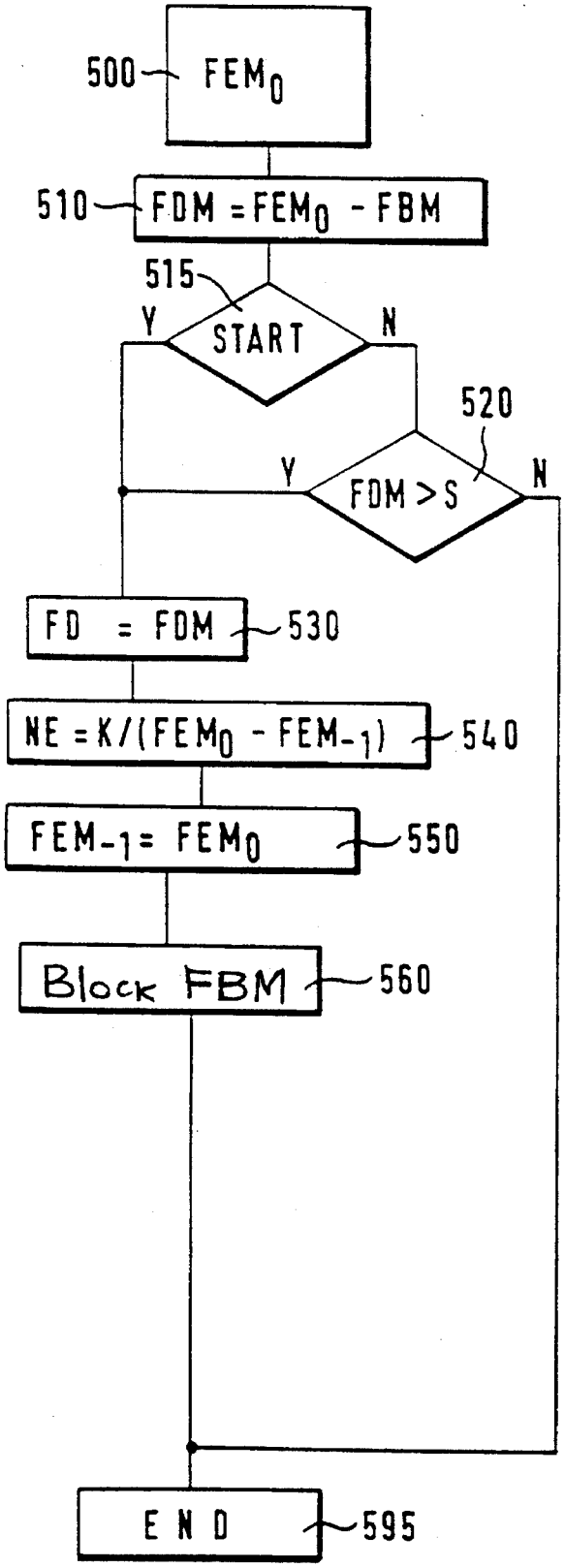
Fig. 5a
Fig. 5b
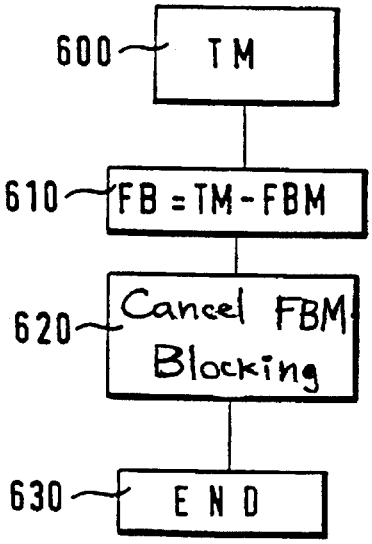

METHOD AND DEVICE FOR CONTROLLING AN INTERNAL COMBUSTION ENGINE

FIELD OF THE INVENTION

The present invention relates to a method and device for controlling an internal combustion engine.

BACKGROUND INFORMATION

German Published Patent Application No. 31 18 425 (corresponding to U.S. Pat. No. 4,426,981) describes a method and a device for controlling an internal combustion engine, in the case of which the fuel quantity injected into the combustion chambers of the internal combustion engine and the supply onset (start of pump delivery) or the onset of injection is detected by means of a pressure sensor. If the differentiated output signal exceeds a threshold value, the onset of injection is recognized. In the case of zero passage for the twice differentiated pressure signal, end of injection is recognized. A fuel-quantity signal results on the basis of the difference between the onset of injection and the end of injection.

An arrangement for detecting the beginning of injection in the case of a diesel internal-combustion engine is likewise known from German Published Patent Application No. 36 12 808 (corresponding to U.S. Pat. No. 5,107,700). It describes detecting the beginning of injection when the output signal from a pressure sensor exceeds a threshold value. The threshold value is formed in dependence upon the peak value of the pressure signal from the preceding injections.

A disadvantage of these methods and devices is that the interference pulses in the pressure signal are recognized as injection-onset or as end-of-injection signals. This, in turn, leads to faulty fuel metering or, in devices where the fuel-quantity signal is used as an injection-duration signal for additional control devices, leads to faulty controlling of the additional devices, such as, for example, of the exhaust-gas recirculation rate.

An object of the present invention, in the case of a method and a device for controlling an internal combustion engine, is to distinguish interference pulses from the useful signal.

SUMMARY OF THE INVENTION

The present invention provides a method and device for controlling a delivery of fuel to an internal combustion engine. At least one of a fuel quantity to be delivered to the engine and a start time for the delivery of fuel to the engine is determined. A duration of the delivery of fuel to the engine is determined as a function of at least one of the fuel delivery start time and an end time for the delivery of fuel to the engine, the fuel delivery duration being indicative of the fuel quantity. It is also determined whether at least one of the fuel delivery start time and fuel delivery end time is valid as a function of whether the fuel delivery duration is greater than a threshold value.

An advantage of the device and method according to the present invention is that the controlling of the internal combustion engine is not adversely affected by interference signals.

BRIEF DESCRIPTION OF THE DRAWINGS

FIG. 5*a* is a flow chart illustrating aspects of an additional exemplary embodiment of the method according to the present invention.

FIG. 5*b* is a flow chart illustrating further aspects of the additional exemplary embodiment of the method according to the present invention.

DETAILED DESCRIPTION

Figure 1:
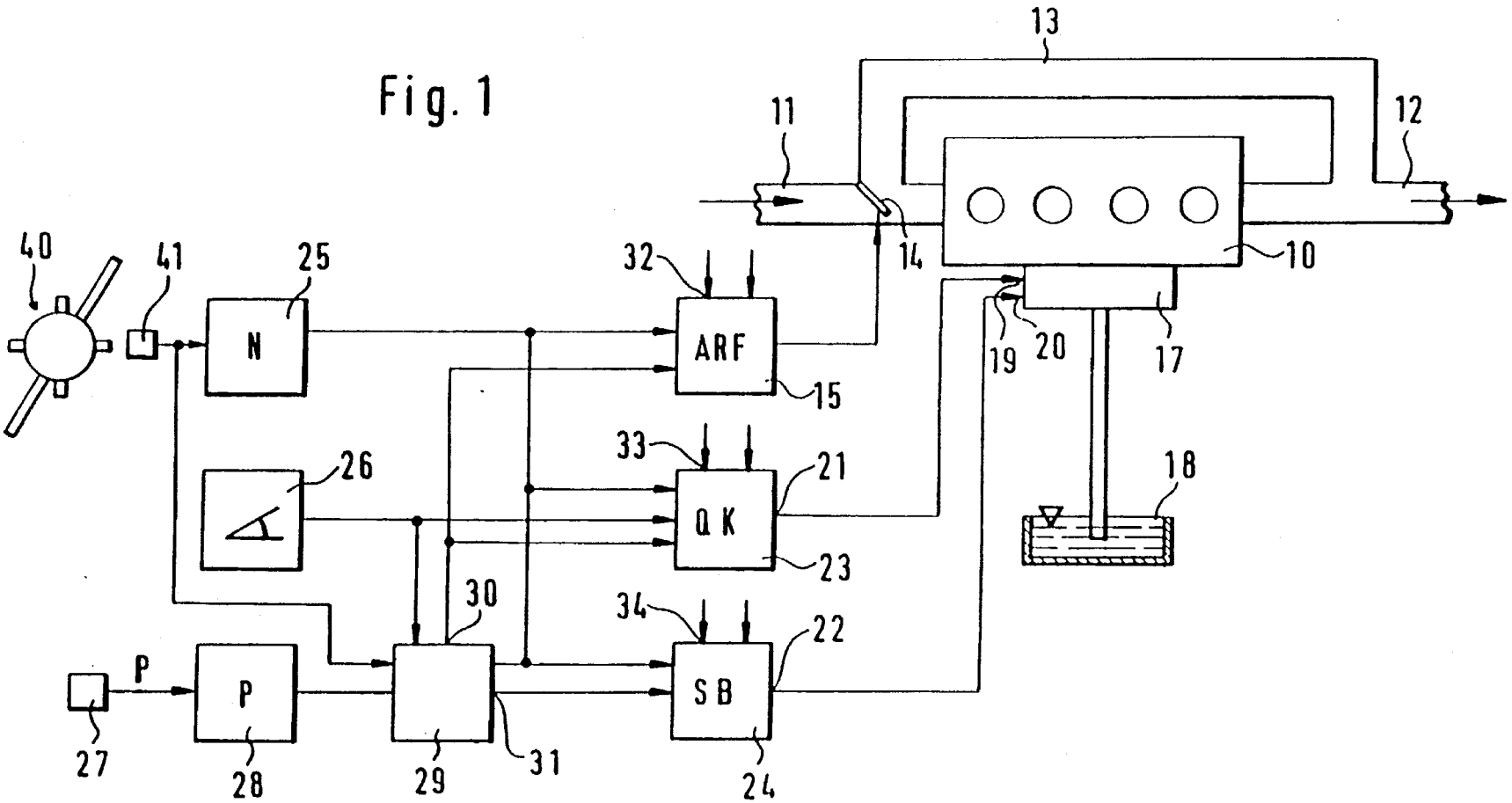
FIG. 1 is a block diagram of the device for controlling an internal combustion engine, according to the present invention.

FIG. 1 shows a self-ignition internal combustion engine, together with its electronic control devices. 10 denotes the internal combustion engine itself, which has an air intake manifold 11 leading to it and an exhaust pipe 12 leading away from it. An exhaust-gas recirculation line is designated by 13. The fresh-air and exhaust-gas components supplied to the internal combustion engine 10 are adjusted by means of a mixing flap 14, which receives its trigger (control) signals via a control stage 15 for the exhaust-gas recirculation rate.

A fuel pump 17 delivers fuel from a tank 18 to the internal combustion engine. The pump itself has two control inputs 19 and 20 for the fuel quantity and the start of pump delivery. These two control inputs 19 and 20 communicate with signal outputs 21 and 22 of a quantity-control stage 23 and of a start-of-injection control stage 24, respectively.

The input variables of the entire device essential to the exemplary embodiment are the engine speed N, the accelerator-pedal position, and a pressure signal with respect to the fuel to be injected. Accordingly, the output signal N of an engine-speed detection circuit 25 attains corresponding inputs of the exhaust-gas recirculation-rate control stage 15, and of the quantity and start-of-injection control stages 23 and 24. An accelerator-pedal position signal is emitted by a corresponding sensor 26 and is fed to the quantity-control stage 23, as well as to a signal-processing stage 29.

The output signal from a pressure sensor 27 is converted in a pressure-evaluation circuit 28 into a pulse-shaped signal. The pressure sensor 27 is preferably arranged so as to detect the pressure in the high-pressure part of the metering system. This means that the pressure prevailing between the fuel pump 17 and the injection nozzles in the combustion chambers or the pressure prevailing in the element chamber is detected. The pressure sensor is preferably arranged in the element chamber of the fuel pump 17 or in the injection lines.

The pulse-shaped signal is then fed to the signal-processing stage 29. The signal-processing stage 29 has two outputs 30 and 31 for the injected fuel quantity and for the start of injection. Accordingly, these outputs 30 and 31 are linked to the exhaust-gas recirculation-rate control stage 15, to the quantity-control stage 23, and to the start-of-injection control stage 24. The three control stages 15, 23 and 24 have additional inputs 32, 33 and 34, respectively. Other operating parameters, such as pressure and temperature values of the inducted air, detected by sensors (not shown), attain the individual control stages 15, 23 and 24 via these inputs.

The speed detection circuit 25 evaluates the signal from a sensor 41, which scans reference marks on a shaft 40. These reference marks are so arranged on the crankshaft or on the camshaft that, for every metering operation, the sensor 41 transmits a pulse-shaped signal to the speed-evaluation circuit 25. In addition, the pulse-shaped signal from the sensor 41 attains the signal-processing stage 29.

The functioning of this device is as follows. On the basis of the accelerator-pedal position, the engine speed N, and the pressure signal, the signal-processing stage 29 calculates a duration of pump delivery, which represents a measure for the injected fuel quantity, as well as a start of pump delivery. Based on the calculated quantity of injected fuel and the engine speed, as well as further operating parameters 32, the exhaust-gas recirculation-rate control stage 15 calculates a trigger signal for influencing the mixing flap, in order to adjust an appropriate exhausts gas recirculation rate. In place of the mixing flap 14, similarly functioning actuators can instead be used.

On the basis of the injected fuel quantity, the engine speed, and the accelerator-pedal position, the quantity-control stage 23 calculates a quantity to be applied to a volume-controlling unit. The volume-controlling unit is, for example, a controller for influencing the control rod of an in-line injection pump or the corresponding final controlling element of a distributor injection pump, or it is an output stage of a solenoid valve or of a solenoid-valve-controlled fuel pump.

Based on the start of pump delivery and the engine speed, as well as on further quantities 34, the start-of-injection control stage 24 determines a control signal to be applied to an actuator to influence the start of pump delivery or the start of injection.

The exact method of functioning of the exhaust-gas recirculation- rate control circuit 15 of the quantity-control stage 23, and of the start-of-injection control stage 24 is known per se.

The distinction will be made in the following among an analog pressure signal P, the output signal from the pressure sensor 27, and a pulse-shaped pressure signal, and the output signal from the pressure-evaluation circuit 28. The pulse-shaped pressure signal will be abbreviated as pressure signal in the following.

One simple refinement of the pressure-evaluation circuit 28 provides for the pulse-shaped pressure signal to have a positive edge, as soon as the analog pressure signal exceeds a first threshold value SP1. This signal has a negative edge when the analog signal falls below a second threshold value SP2. Besides the actual useful signal, the analog pressure signal also contains interference pulses. When they reach a certain height, these interference pulses produce rising and falling edges, even in the case of a pulse-shaped pressure signal.

The pressure-evaluation circuit 28 supplies a start-of-pump-delivery and an end-of-pump-delivery signal, the rising edge being regarded as the start-of-pump-delivery signal and the falling edge as the end-of-pump-delivery signal. The difference between the start-of-pump-delivery signal and the end-of-pump-delivery signal serves as a duration-of-pump-delivery signal. This duration of pump delivery is a measure of the injected fuel quantity.

To differentiate between interference pulses and useful pulses, it is provided for the start-of-pump-delivery signal and/or the end-of-pump-delivery signal to be recognized as plausible (valid) when the duration-of-pump-delivery signal is greater than a threshold value. These plausibility considerations follow from the signal-processing stage 29. Furthermore, the signal-processing stage 29 makes available an equivalent engine-speed signal.

The generation of the pulse-shaped pressure signal by the pressure-evaluation circuit 28 can also be realized differently. Thus, it can also be provided that a positive edge is produced when the differentiated analog pressure signal exceeds a specific threshold value. On the other hand, it can also be provided that a negative edge is produced when the twice differentiated analog pressure signal has a passage through zero.

The method of functioning of the signal-processing stage 29 and of the pressure-evaluation circuit 28 shall be clarified in the following on the basis of FIGS. 2*a* and 2*b*.

Figures 2A, 2B:
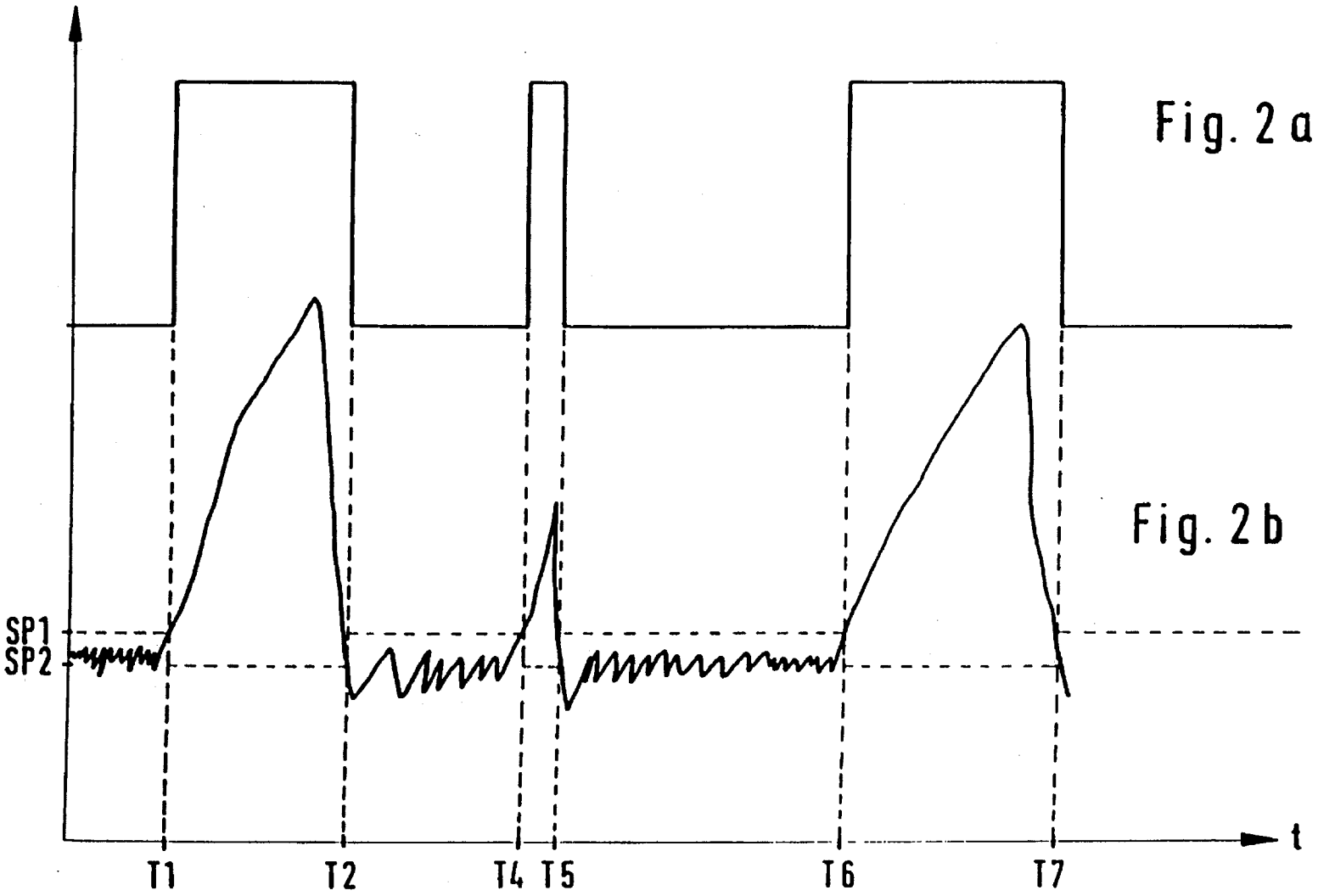
FIG. 2*a* is a timing diagram of the output signal from the pressure sensor.
FIG. 2*b* is a timing diagram of the output signal from the pressure-evaluation stage.

Various signals are plotted over time in FIGS. 2*a* and 2*b*. In FIG. 2*a*, the output signal P from the pressure sensor 27 is plotted with a solid line. Furthermore, two threshold values SP1 and SP2 are plotted as dotted lines. The output signal from the pressure-evaluation stage 28 is plotted in FIG. 2*b*.

At the instant T1, the analog pressure signal P exceeds a first threshold value SP1. This results in a positive or a rising edge at the output of the pressure-evaluation circuit 28. The current counter content FBM of a continuously updated counter is stored as a start-of-pump-delivery value FBM.

At the instant T2, the analog pressure signal P falls below a second threshold value SP2, which, in turn, results in a negative edge at the output of the pressure evaluation 28. The counter content of the continuously cycling counter at the negative edge $FEM_{-1}$ is stored as an end-of-delivery value.

At the instant T4, an interference pulse occurs, in the case of which the analog pressure signal again exceeds the first threshold SP1, which leads, in turn, to a rising edge in the case of the pressure signal. At the instant T5, the analog pressure signal falls below the second threshold SP2, which is recognized as an end-of-delivery signal. The current counter content FBM is stored at the instant T4, and the current counter content $FEM_0$ at the instant T5.

The duration of pump delivery FDM is calculated on the basis of the stored values FBM and $FEM_0$. If this value is smaller than a threshold S, which is the case at the instant T5, then this value is rejected as being implausible.

At the instant T6, the analog pressure signal again exceeds the first threshold SP1 and, at the instant T7, the signal falls below the second threshold SP2. This results in a rising edge occurring at the instant T6, and a falling edge occurring at the instant T7. The start-of-pump-delivery signals FBM at the instants T1 and T6 and the end-of-delivery signals at the instants T2 and T7 are recognized as being plausible on the basis of the duration of pump delivery.

The pressure-evaluation circuit 28, the signal-processing stage 29, and the remaining control stages 15, 23 and 24 are preferably implemented as microcomputers. A flow chart for clarifying the functional sequence in the signal-processing stage 29 is depicted in FIGS. 3*a* and 3*b*.

Figures 3A, 3B:
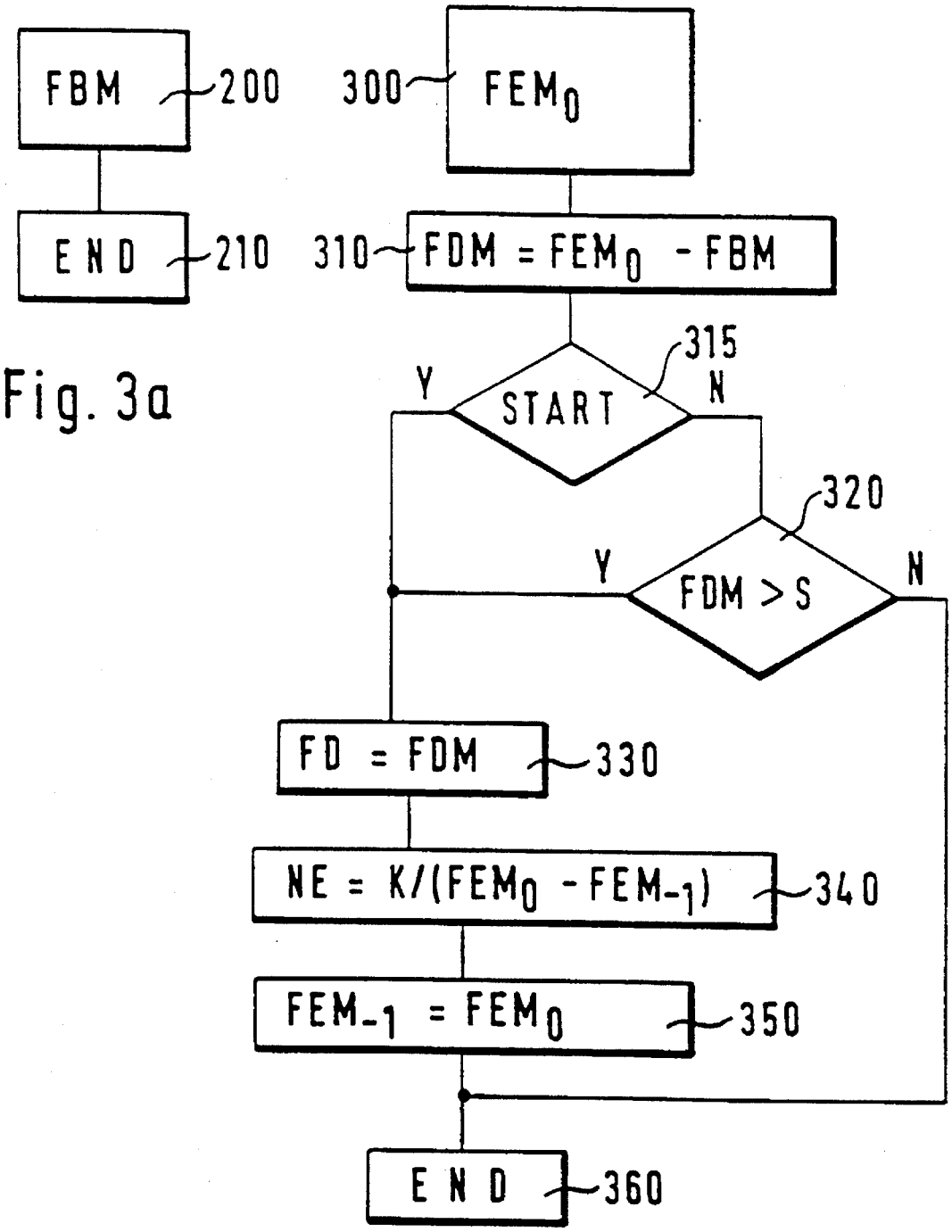
FIG. 3*a* is a flow chart illustrating an aspect of the method according to the present invention.
FIG. 3*b* is a flow chart illustrating further aspects of the method according to the present invention.

With every recognized positive edge, the functional sequence illustrated in FIG. 3*a* starts in a step 200. The counter content of a continuously cycling counter is stored in this step 200. The counter content serves as a start-of-pump-delivery signal FBM upon the occurrence of the positive edge of the pressure signal.

The program ends in step 210. It starts anew as soon as a positive edge is recognized again. At every recognized negative edge, the functional sequence shown in FIG. 3*b* starts in a first step 300. In this step 300, the counter content of a continuously cycling counter is stored as a start-of-pump-delivery signal $FEM_0$.

In step 310, the duration of pump delivery FDM is defined as the difference between the end-of-delivery signal $FEM_0$ and the start-of-delivery signal FBM.

One refinement of the present invention provides that there will be no plausibility (reasonableness) check in the case of a start. The query 315 checks whether a start situation is at hand. If a start situation is at hand, step 330 follows immediately. If a start situation is not at hand, the plausibility query 320 follows.

The query 320 checks whether the signal is plausible. The interference pulses are shorter than the metering pulse. It is checked whether the duration of pump delivery FDM is greater than a threshold S. If this is not the case, the signal-processing stage recognizes an interference pulse. The program is subsequently ended with step 360.

In a simple embodiment, a fixed value is specified for the threshold S. This value is smaller than the smallest possible metering time. In particular, in the case of small loads, it can happen that the duration of pump delivery attains the range of the threshold S. It is, therefore, advantageous when the threshold S is selected in dependence upon the operating parameters. The threshold value is preferably dependent upon at least the speed and/or the load of the internal combustion engine.

As a load signal, one can select, on the one hand, the accelerator-pedal position, the output signal from the fuel-quantity control 23 or the duration-of-pump-delivery signal of the preceding metering, or an average value over several metering operations. The threshold value is preferably specified on the basis of a duration-of-pump-delivery signal recognized at an earlier instant as being plausible.

If the query 320 recognizes that a useful signal was at hand, the duration-of-pump-delivery signal FDM is output in step 330 as a duration of pump delivery FD. In some instances, on the basis of this signal, the actually injected fuel quantity is determined starting from the duration of pump delivery FD, and is routed to the remaining control stages. An equivalent engine-speed signal NE is subsequently calculated in step 340. This engine-speed signal NE preferably follows in accordance with the formula:

$$NE=K/(FEM_0-FEM_{-1})$$

In this case, K is a proportionality constant, $FEM_0$ is the current start-of-pump-delivery signal, and $FEM_{-1}$ is the previous start-of-pump-delivery signal that had been recognized as permissible. The preceding start-of-pump-delivery signal $FEM_{-1}$ is overwritten in step 350 by the current start-of-pump-delivery signal $FEM_0$. The program execution subsequently ends in step 360. It starts anew as soon as a negative edge is recognized again.

Another refinement of the present invention shall be explained in the following on the basis of FIGS. 4*a*–4*c* and 5*a*–5*b*. In this refinement, in addition to the duration of pump delivery signal and the engine-speed equivalent signal, it is also possible to determine a start of pump delivery. The time span between the rising edge of the pressure signal or of the start-of-pump-delivery signal up to a reference signal is used as a start of pump delivery.

Figures 4A, 4B, 4C:
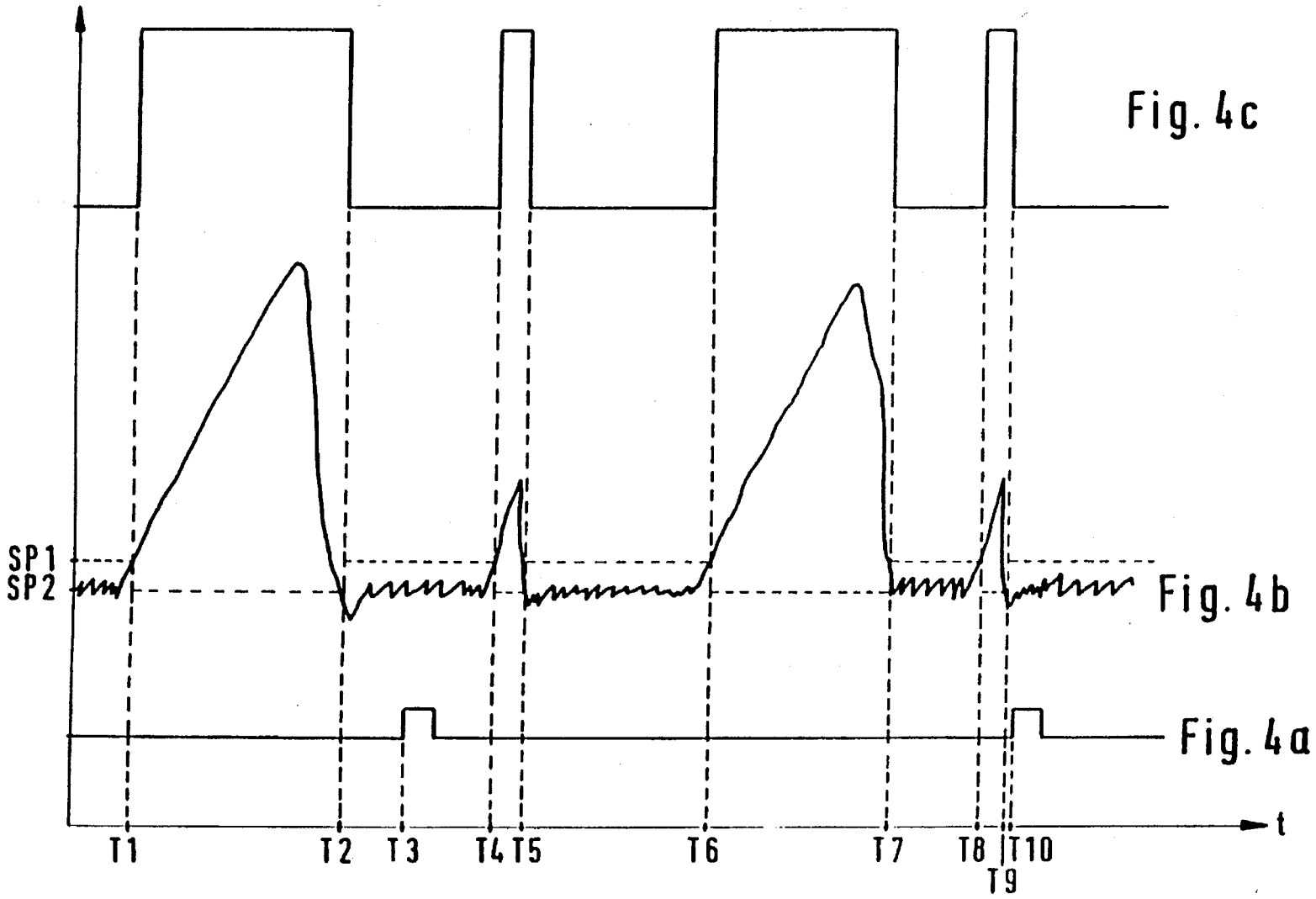
FIG. 4*a* is a timing diagram of the pulse-shaped output signal from the sensor.
FIG. 4*b* is a timing diagram of the output signal from the pressure sensor.
FIG. 4*c* is a timing diagram of the output signal from the pressure-evaluation stage.

In FIGS. 4*a*–4*c*, various signals are plotted over time comparably to FIGS. 2*a* and 2*b*. The pulse-shaped output signal from the sensor 41, which scans the reference marks of the pulse wheel 40, is plotted in FIG. 4*a*. In FIG. 4*b*, the output signal P from the pressure sensor 27 is plotted with a solid line. In addition, two threshold values SP1 and SP2 are entered with dotted lines. The output signal from the pressure-evaluation stage 28 is plotted in FIG. 4*c*.

In the specific embodiment depicted in FIGS. 4*a*–4*c*, the reference signal appears after the start-of-pump-delivery signal. Here, the distinction must be made between two cases. In the first case, the reference pulse follows from the positive edge of the pressure signal. Interference pulses cannot occur here. In the second case, the reference pulse follows the trailing edge of the pressure signal. Here, interference pulses can occur between the trailing edge and the reference pulse. To prevent this, after an end-of-delivery signal has been plausibly detected, the storage of start-of-pump-delivery signals is blocked. This blocking is canceled again following the reference pulse.

This is depicted in FIGS. 4*a*–4*c*. At the instants T1, T4, T6 and T8, the analog pressure signal exceeds the first threshold value SP1; this results in a rising edge in the case of the pressure signal. At the instants T2, T5, T7 and T9, the analog pressure signal falls below a second threshold SP2; this results in a trailing edge of the pressure signal. The time intervals between T1 and T2, as well as between T6 and T7 are recognized as useful signals, and the time intervals T4, T5, as well as T8, T9 as interference pulses. A reference pulse occurs at the instant T3 and at the instant T10.

The counter content at the instant T1 is stored as a start-of-pump-delivery signal FBM. The counter content at the instant T2 is stored as an end-of-delivery signal $FEM_{-1}$. The counter content at the instant T3, as well as at the instant T10 is stored as a reference signal TM. The counter content at the instant T4 is stored as a start-of-pump-delivery signal FBM, and the counter content at the instant T5 as an end-of-delivery signal $FEM_0$, but is subsequently rejected as being implausible. At the instant T7 and at the instant T2, the counter contents are stored as an end-of-delivery signal $FEM_0$. These stored values are recognized as being plausible, which in turn results in the storing of new start-of-pump-delivery values FBM being blocked until the appearance of the reference signal TM. This has as a result that no start-of-pump-delivery signal and no end-of-delivery signal is stored at the instants T8 and T9.

The interference signal between the instants T4 .and T5 is recognized on the basis of its time duration, and the signal between instants T8 and T9 on the basis of its position with reference to the reference pulse TM as an interference pulse.

The method of functioning of this device is clarified on the basis of the flow chart in accordance with FIGS. 5*a* and 5*b*.

The steps 500–550 correspond to the blocks 300–350 of FIG. 3*b*. Following step 550, given start-of-pump-delivery and end-of-delivery signals recognized as being plausible, the storing of further start-of-pump-delivery signals is blocked in step 560.

The subroutine then ends in step 595. At every recognized edge of the reference signal, the functional sequence depicted in FIG. 5*b* starts in step 600. The counter content is stored as a reference signal TM in this step 600.

In step 610, the start of pump delivery FB is determined on the basis of the reference signal TM and the start-of-pump-delivery signal FBM.

The blocking of the storage of the start-of-pump-delivery signal is subsequently canceled in step 620. The subroutine ends in step 630. It begins anew as soon as a reference-signal edge is detected.

What is claimed is:

1. A method for controlling a delivery of fuel to an internal combustion engine, comprising the steps of:

determining at least one of a fuel quantity to be delivered to the engine and a start time for the delivery of fuel to the engine;

determining a duration of the delivery of fuel to the engine as a function of at least one of the fuel delivery start time and an end time for the delivery of fuel to the engine, the fuel delivery duration being indicative of the fuel quantity;

determining whether the fuel delivery duration is greater than a predetermined threshold value; and determining whether at least one of the fuel delivery start time and fuel delivery end time is valid as a function of whether the fuel delivery duration is greater than the predetermined threshold value.

2. The method according to claim 1, wherein the predetermined threshold value is a function of at least one of an engine speed and an engine load.

3. The method according to claim 1, wherein the predetermined threshold value is a function of a previously-determined, valid fuel delivery duration.

4. The method according to claim 1, wherein the fuel delivery start time is determined as a function of a time difference between a start signal and a reference signal.

5. The method according to claim 1, wherein the validity is determined by comparing at least one of a start signal and an end signal to a reference signal.

6. The method according to claim 5, further comprising the step of determining whether at least one additional start signal is valid, after the start signal is recognized until the reference signal is recognized.

7. The method according to claim 6, further comprising the step of determining an engine speed as a function of at least one of the start signals and the end signal.

8. The method according to claim 1, further comprising the step of detecting an element-chamber pressure of the engine.

9. The method according to claim 1, further comprising the step of detecting an injection-line pressure of the engine.

10. The method according to claim 1, wherein the validity is determined only during non-start-up operation of the engine.

11. The device for controlling a delivery of fuel to an internal combustion engine, comprising:

means for determining at least one of a fuel quantity to be delivered to the engine and a start time for the delivery of fuel to the engine;

means for determining a duration of the delivery of fuel to the engine as a function of at least one of the fuel delivery start time and an end time for the delivery of fuel to the engine, the fuel delivery duration being indicative of the fuel quantity;

means for determining whether the fuel delivery duration is greater than a predetermined threshold value; and means for determining whether at least one of the fuel delivery start time and fuel delivery end time is valid as a function of whether the fuel delivery duration is greater than the predetermined threshold value.

12. The device according to claim 11, wherein the at least one of the fuel quantity and the fuel delivery start time is determined through use of a pressure sensor.

13. The device according to claim 11, wherein the delivery of fuel is by fuel injection.

14. The device according to claim 11, wherein the delivery of fuel is from a fuel pump.

* * * * *